United States Patent [19]

Jacob

[11] 4,383,415

[45] May 17, 1983

[54] REFRIGERATION AND WATER CONDENSATE REMOVAL APPARATUS

[76] Inventor: Carlyle W. Jacob, 118 Presidents La., Quincy, Mass. 02169

[21] Appl. No.: 292,341

[22] Filed: Aug. 12, 1981

Related U.S. Application Data

[63] Continuation-in-part of Ser. No. 100,266, Dec. 4, 1979, abandoned, which is a continuation-in-part of Ser. No. 920,242, Jun. 29, 1978, abandoned, which is a continuation-in-part of Ser. No. 811,765, Jun. 20, 1977, abandoned, which is a continuation-in-part of Ser. No. 611,864, Sep. 10, 1975, abandoned.

[51] Int. Cl.[3] ..... F25B 25/00

[52] U.S. Cl. ..... 62/81; 62/93; 62/100; 62/155; 62/281; 62/288

[58] Field of Search ..... 62/100, 272, 281, 287, 62/288, 282, 82, 93, 81, 155, 234; 138/45, 46; 55/267, 467, 257 HE

[56] References Cited

U.S. PATENT DOCUMENTS

| | | | |
|---|---|---|---|
| 2,909,907 | 10/1959 | Swanson | 62/155 |
| 3,010,288 | 11/1961 | Jacobs | 62/155 |
| 3,174,297 | 3/1965 | Kuhn et al. | 62/155 X |
| 3,383,878 | 5/1968 | Booth | 62/272 X |
| 3,453,838 | 7/1969 | Decker et al. | 62/155 |
| 3,565,166 | 2/1971 | Huebscher et al. | 62/272 X |
| 3,905,203 | 9/1975 | Jacob | 62/281 X |

*Primary Examiner*—William E. Tapolcai

*Attorney, Agent, or Firm*—Louis Orenbuch

[57] ABSTRACT

An air cooling and water condensate removal panel has at least two interconnected capillary systems close to a plate having cooling means for removing heat from the plate. The first capillary system exists in a porous, thin outer layer having a very fine capillary structure which presents a cool, wettable surface upon which moisture in the air condenses. The outer layer is maintained cool by the cold plate. The condensate water soaks through the thin porous outer layer and is drawn into the interconnected second capillary system. The second capillary system is substantially coarser than the first system to cause the water to be drawn away more rapidly than the condensate can form upon the outer surface. The water in the coarser capillary system is drawn into a discharge pipe, preferably by employing a pump to maintain a mild vacuum in the pipe. A vacuum reducer or regulator is employed at or near the juncture of the discharge pipe and the air cooling panel to reduce the strength of the vacuum produced in the discharge pipe by the pump. The vacuum strength is reduced to the level where the water seals in the capillary openings of the outer capillary layer will not be broken, thus preventing air from entering the cooling panel. In addition means are employed to prevent ice formations from damaging the structure. These means include thin flexible undulating sheets in the inner and outer capillary systems to absorb the expansive forces of the ice.

46 Claims, 9 Drawing Figures

REFRIGERATION AND WATER CONDENSATE REMOVAL APPARATUS

RELATED APPLICATIONS

This application is a continuation-in-part of my application Ser. No. 100,266 which was filed on Dec. 4, 1979, now abandoned. My application Ser. No. 100,266 is a continuation-in-part of my earlier application Ser. No. 920,242 which was filed on June 29, 1978 and was later abandoned. That earlier application is a continuation-in-part of my prior application Ser. No. 811,765 which was filed on June 20, 1977 and was later abandoned. That prior application, in turn, is a continuation-in-part of my parent application Ser. No. 611,864 which was filed on Sept. 10, 1975 and was later abandoned.

SUMMARY OF THE INVENTION

This invention relates in general to improvements in air cooling and water condensate removal systems. More particularly, the invention relates to improved means for collecting and conducting away the water that condenses out of the air upon the cold surfaces of the cooling system.

OBJECTIVES OF THE INVENTION

The primary objective of the invention is to provide apparatus for cooling the air while causing the water which condenses upon the cooling surfaces to be removed. It is a further object of the invention to provide cooling and dehumidifying apparatus which can be incorporated into a structure so as to become part of its ceiling or walls. In the employment of the invention, it is preferred that the cooling surfaces be located on the ceiling or upper part of the walls of the room or container where the warmer air is encountered. A further object is to provide a cooling surface for the inside of a refrigerator with means for removing the water that condenses thereon.

THE INVENTION

The invention concerns an air cooling and water condensate removal apparatus that is preferably embodied in the form of a thin flat panel having one face presenting a fine, wettable, porous surface. In the panel is a cold plate having means, such as a circulating fluid coolant, for removing heat from the plate. The wettable surface is the exposed face of a thin porous sheet having capillary openings that is maintained cool by the cold plate to cause moisture in the ambient air to condense upon that surface. Because the layer has capillary openings, the condensate water soaks through the thin outer layer and enters an adjacent second capillary system. The second capillary system is much coarser than the system of fine capillaries in the outer layer. The water entering the coarser system, therefore, can proceed quickly through that system to a discharge pipe which drains the coarse system. To facilitate the drainage of the second capillary system, a mild vacuum is maintained in the discharge tube. The thin outer layer may also include finely toothed areas that conduct water laterally to capillary openings that connect to the adjacent second capillary system. The invention resides in an improvement upon the air cooling and water condensate removal apparatus by the addition of a vacuum reducer or regulator at or near the juncture of the discharge tube and the cooling panel to cause the vacuum inside the cooling panel to be less than that existing in the discharge tube. To prevent damage to the panel from ice formations, further improvement resides in having the outer capillary sheet rigidly attached to the other portions of the panel only at the edges of the sheet whereby the unattached portion of the sheet retains some freedom of motion which adds to its resiliency and permits the accomodation of ice formation. Further resiliency is achieved by employing thin flexible undulating sheets in the inner and outer capillary systems. In some embodiments the sheets are attached to the panel at many points over the area of the panel. A further improvement resides in a programmed fan for circulating cold dry air inside a freezer.

THE DRAWINGS

The invention, both as to its construction and its mode of operation, can be better understood from the following exposition, when it is considered in conjunction with the accompanying drawings in which.

THE EXPOSITION

Figure 1:
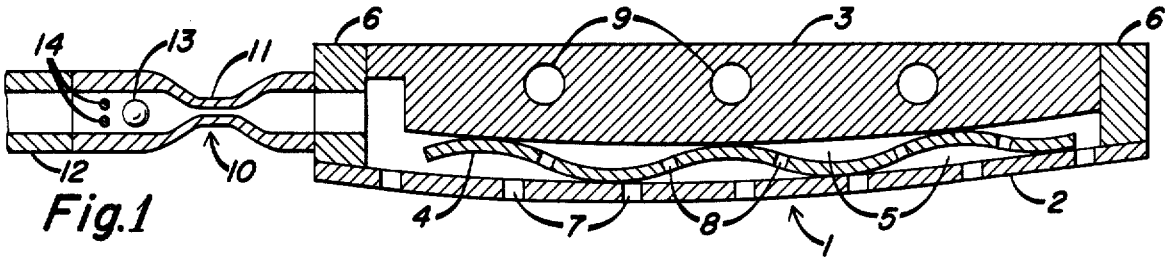
FIG. 1 is a cross-sectional view in elevation of the invention embodied in the form of a cooling panel connected to a vacuum regulator.

As discussed in my U.S. Pat. No. 3,905,203, a cooling and water condensate removal structure functions best if the structure includes suction pumping means for drawing the condensate water up through the outer porous layer of the panel to the discharge tube and thence along the full length of the discharge tube to the exit end of the tube. Since the discharge tube may rise a rather considerable height above the cooling panel, a relatively strong suction may be needed to raise the water to this height. In addition to this suction, a strong suction not related to the suction pump may also be created in the cooling panel if the discharge tube turns downward many feet from the panel to, say, the basement of a building and if this tube has an internal diameter of no more than about ¼ inch. Then the water in the tube will span across the tube and the weight of the water in the long tube will create a strong suction at the upper end of the tube and thus in the cooling panel. This strong suction in the panel, regardless of how it is created, whether by a strong suction pump or by a long column of downwardly flowing water, can break the water seals in the pores of the outer porous layer of the panel and cause a gurgling sound as air enters and flows through the pores. This noise can be very undesireable.

One solution to this problem, discussed in my aforesaid U.S. Pat. No. 3,905,203, is to introduce a very small amount of air into the panel through a special air intake where the air can be introduced quietly. This reduces the suction requirements and can prevent air from entering through the pores. However, unless this air is introduced carefully some gurgling sounds may still be heard. An alternate proceedure is to employ a pressure or, more precisely, a suction reducer or regulator at the junction where the discharge tube connects with the cooling panel. Then a strong suction can exist in the discharge tube but this strong suction is attenuated before it reaches the interior of the panel. If a good suction regulator is employed, the suction in the interior of the panel can be maintained at a constant relatively weak level. This weak suction in the interior of the panel should of course still be sufficiently strong to draw the condensate water from the outer surface of the panel up into the panel but not so strong as to break the water seals in the fine pores of the panel. Particularly when employing a perforated sheet as the outer layer of the panel, it is usually cheaper to build a sheet having large instead of small perforations. However, large perforations tend not to hold a water seal unless the suction in the panel is quite mild. Water seals in a pore are formed because of the surface tension of the water in the pore and this seal will remain tight provided the pressure difference across the pore does not exceed a certain critical value. This critical value is a function of the diameter of the pore—the larger the diameter of the pore the smaller the pressure difference that can be tolerated across the pore without rupture of the water seal.

In FIG. 1 there is shown schematically a cooling panel 1 having a lower porous sheet 2 on which moisture from the air condenses. A mild suction in the interior of the panel draws the condensate water up into the panel. The panel is connected to a discharge tube 12 by way of a pressure regulator 10. A suitable pump such as a conventional suction pump, not shown, draws water from the regulator 10 into the discharge tube 12. The regulator 10 consists of a tube having a constriction 11, as shown, which impedes the flow of fluid sucked out of the panel. Consequently, the suction on the panel side of the constriction is less than the suction on the discharge tube and suction pump side of the constriction. To form a rudimentary aromatic suction regulator, the constricted portion of the tube is thin walled and is composed of an elastic material such as rubber. Then the stronger the suction in the system the more the outside atmospheric pressure compresses the rubber and reduces the size of the constriction. This smaller sized constriction further impedes the flow of fluid leaving the panel so that the low pressure in the panel can be made to remain at an approximately constant level. The cross-section of the constriction need not necessarily be round but may be made elliptical, for example, to increase the sensitivity of the regulation. An elastic constriction type of regulator may not be a perfect regulator but it may be sufficiently good to greatly improve the performance of the cooling panel. If the constriction 11 were rigid instead of flexible walled, the level of suction in the panel would still be reduced but the degree of suction would not be nearly as well controlled as with the flexible walled constriction.

For ease of differentiation, a rigid walled constriction will be termed a "suction reducer" while the flexible walled constriction will be termed a "suction regulator". A suction regulator generally has a movable member such as a flexible member while a simple suction reducer usually does not. In the art of pressure control many types of pressure regulators having varying degrees of precision control have been perfected. A flexible walled regulator such as that shown in FIG. 1 is simply one example of a suction regulator. Although this regulator would generally be employed in an air cooling and dehumidifying structure in which no air was admitted it could also be employed usefully in an air cooling structure in which some air was admitted into the structure. This regulator 10 is shown positioned just outside the panel 1. It can be incorporated within the panel. In any case whether inside or outside the panel it should preferably be somewhere near the discharge end of the panel. Conceivably the regulator might be located a foot or even several feet away from the panel provided the portion of the discharge tube between the regulator and the panel was relatively level so as not to destroy the usefulness of the regulator.

In the air cooling panel of FIG. 1, the porous sheet 2 is preferably a perforated sheet and is so illustrated. That perforated sheet is slightly spaced from a heat absorbing or cold plate 3 by a corrugated spacing sheet 4. Moisture which condenses on the lower surface of the perforated sheet is drawn up through the perforations 7 into the inner passageways 5 and is discharged from those passageways through the suction regulator 10. The cold plate 3 may be cooled by a cooling fluid circulated through passageways 9 in the cold plate. The underside of panel 1 is slightly convex, as shown, with the perforated sheet 2 tightly stretched laterally between insulative end pieces 6. The spacing means between the perforated sheet and the cold plate may be rigid but preferably is springy. To provide resiliency, a thin corrugated spacing sheet 4 composed of a springy metallic material is employed. This corrugated spacing sheet provides a thermal path between perforated sheet 2 and the cold plate 3. Bonding agents or welds or other fastening agents are not needed to cause the perforated sheet to make good contact with the cold plate since the tension in the tightly stretched curved perforated sheet 2 insures that this perforated sheet has a strong upward thrust pressing firmly against the spacing sheet. The big advantage of employing springy spacing means is that it enables the perforated sheet to very positively and uniformly contact the spacing means and the spacing means to very positively and uniformly contact the cold plate. The spacing sheet 4, being corrugated, provides inner passageways 5 for channeling away the condensate water drawn up through the perforated sheet. The spacing sheet is preferably punctured with many holes 8 to interconnect the channels 5 on both sides of the sheet which carry away the water to the discharge end of the panel.

When water in the inner passageways 5 freezes, the ice may stretch the perforated sheet a very minute amount. However, when the ice thaws, the perforated sheet will return to its original state without any injury occuring to the sheet. This is an example of a resilient panel construction that protects the panel against the disruptive forces of freezing water.

Instead of employing a springy spacing means, perforated sheet 2 itself may be made slightly corrugated for added springiness. If the perforated sheet 2 is suitably corrugated, the spacing sheet 4 can (if desired) be dispensed with as the corrugations in the corrugated perforated sheet then can serve as spacing members and provide channels to carry away the condensate water that is drawn up through the perforations in the sheet.

Figure 4:
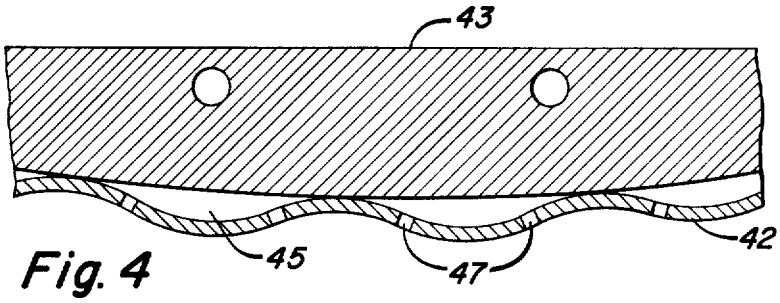
FIG. 4 depicts a cross-sectional view in elevation of a portion of still another embodiment of the cooling panel.

FIG. 4 shows a small cutaway section of a cold plate 43 with a corrugated perforated sheet 42 directly beneath it and in contact with the cold plate. The channels 45 formed by the valleys in the corrugated sheet 42 connect with the discharge tube of the panel to carry away the water drawn up through the perforated sheet. If the perforated sheet is suitably stretched laterally as in the FIG. 1 panel, then bonding agents are again unnecessary.

The spacing sheet 4 may be dimpled instead of corrugated with the dimples forming a two dimensional array of protrusions in the spacing sheet rather than long parallel ridges and valleys as in a corrugated sheet. Thus the undulations in a springy spacing sheet may be dimples or corrugations. If dimples are employed they should be suitably shaped to insure satisfactory springiness of the spacing sheet. The greater the springiness, the more uniformly the spacing sheet will contact the perforated sheet and the cold plate, thus insuring good thermal connections between the perforated sheet and the cold plate. The resultant thermal connections or paths need not be perfect but they should be adequate to enable the cold plate to reasonably rapidly cool the perforated sheet.

A perforated sheet is said to be in good thermal contact with the cold plate or to have good thermal paths to the cold plate if heat can readily flow from the perforated sheet to the cold plate to thereby enable the cooling panel to rapidly cool the ambient air. There may be a spacing member such as a springy metallic spacing sheet between the perforated sheet and the cold plate but if heat can still readily flow from the perforated sheet to the spacing sheet and thence to the cold plate then the perforated sheet and cold plate are still said to be in good thermal contact with one another and to have good thermal paths between them. There might even be an unusually thin film of ice between the spacing sheet and the perforated sheet or the spacing sheet and the cold plate but if this thin ice film does not unduely inhibit the flow of heat from the perforated sheet to the cold plate then the perforated sheet and the cold plate will still be in good thermal contact with one another and over the broad expense of the perforated sheet there will still be good thermal paths or connections between the perforated sheet and the cold plate.

The thickness of spacing sheet 4 need not be constant throughout the length and breadth of the sheet. The central region of the sheet can be rather thick and that thickness can be made to taper down as one moves toward the left and right hand edges of the sheet to become quite small at those edges. This type of tapered construction of the spacing sheet accentuates the curvature of the cold plate as it causes the stretched perforated sheet to have an even greater curvature than in the case where the spacing sheet has a uniform thickness. This increased curvature in the perforated sheet will enable the stretched perforated sheet to press even more firmly against the spacing sheet. When referring to the thickness of a corrugated or dimpled sheet it is the overall thickness of the sheet which includes the peaks and valleys of the undulations in the sheet that is being referred to. If the thickness of the spacing sheet has a sufficient taper, then even if the underside of the cold plate is flat the perforated sheet will still have a curvature. It is this curvature of course that causes the tightly stretched perforated sheet to press in an upwards direction firmly against the spacing sheet to insure a good thermal conduction path between the perforated sheet and the cold plate.

Figure 2:
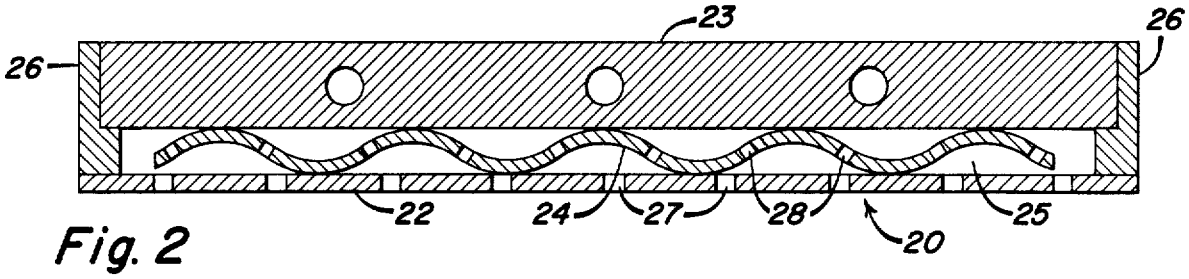
FIG. 2 is a cross-sectional view in elevation of another embodiment of the cooling panel.

FIG. 2 shows another variation of a cooling panel that does not require bonding agents or welds in the broad central area of the panel. The panel 20 includes a cold plate 23 having a relatively flat undersurface. Beneath the cold plate and spaced from it is a thin flat perforated sheet 22 that is firmly secured at its edges to the frame 26. This frame, which may be composed of an insulative material, extends around the perimeter of the panel and is composed of four edge strips, one for each side of the panel. Two of these edge strips are shown in cross-section in FIG. 2 as part of the frame 26. Before securing frame 26 to the cold plate, a springy undulating spacing sheet 24 is positioned between the cold plate 23 and the perforated sheet 22. The thickness of the spacing sheet when in an unstressed state should be substantially greater than the separation that would exist between the cold plate and the perforated sheet were the oversized spacing sheet not present. However, in attaching frame 26 to the cold plate, one must push up on the frame and in so doing also push the perforated sheet up hard against the oversized spacing sheet causing the spacing sheet to become compressed. Thus when the panel is completely assembled the spacing sheet is in a state of compression, pressing hard against both the cold plate and the perforated sheet. In pressing against the perforated sheet, the spacing sheet causes the perforated sheet to bow downwards slightly so that the underside of the perforated sheet becomes slightly convex. The surface of the bowed perforated sheet will approximate that of a section of a spherical surface in which the radius of the sphere is very large. This bowing downwards of the perforated sheet creates a large tensile stress within the perforated sheet and that is why the perforated sheet must be secured very firmly to the frame 26 and it is also why this frame should be strong and reasonably rigid. When water does freeze within the panel 20 it may cause a slight displacement between the perforated sheet and the spacing sheet but this displacement, because of the springiness of the spacing sheet and to a much lesser degree of elasticity in the perforated sheet, will not cause injury to the panel.

The tensile stresses within the bowed perforated sheet insure that the perforated sheet is always firmly pressing upwards against the spacing sheet. Thus the perforated sheet makes broad uniform positive contact with the spacing sheet and the spacing sheet makes broad uniform positive contact with the cold plate. This broad uniform positive contact insures that the perforated sheet and cold plate are in good thermal contact with each other thus permitting the heat in the perforated sheet to be rapidly drawn up into the cold plate. Having a perforated sheet slightly bowed downward and also stressed laterally in tension can be an ideal way of causing the sheet to have the necessary upward component of force that will insure that the perforated sheet will press hard against the other portions of the panel above it.

One side of frame 26 should have a hole in it to enable a discharge tube or suction regulator to be attached to the panel and drain away the water from inner passageways 25. The corrugated spacing sheet 24 may be punctured by many holes 28 to provide channels or inner passageways on both sides of the spacing sheet to aid in draining away the water.

Figure 3:
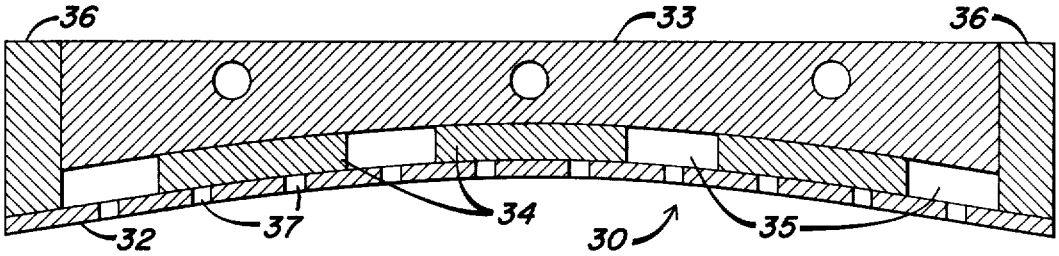
FIG. 3 depicts a cross-sectional elevation view of still another embodiment of the cooling panel.

There are several ways of causing the perforated sheet to have an upward component of force. Stressing the sheet laterally in tension is one way. Stressing the sheet laterally in compression is another way. FIG. 3 shows a panel which is similar to the FIG. 1 panel except that the undersurface portions of the panel are concave instead of covex. The perforated sheet 32 having perforations 37 is secured to the end strips 36 in a manner whereby the end strips exert a push against the perforated sheet in a direction that is parallel to the perforated sheet thereby tending to compress the perforated sheet in a lateral direction. This causes the arched perforated sheet 32 to exert an upwards thrust against the spacing means 34 while pressing firmly against these spacing means. The spacing means 34 is preferably composed of a material that is a good conductor of heat. The spacing means may be an integral part of the cold plate or it may be separate. The arched perforated sheet 32 behaves in a somewhat analagous manner to the arch of a bridge where the greater the load on the bridge the more the arch will be compressed. The end strips 36, acting as the buttresses of the arched bridge, absorb the load on the perforated sheet caused by the downward pressure of the spacing means 34. A panel having a concave undersurface may again have a springy undulating spacing sheet instead of the rigid spacing means 34 that is shown. A springy undulating spacing means when used may again be tapered but the thickness of the spacing sheet should now be greatest at the left and right hand ends of the sheet rather than in the middle. Also if the arched perforated sheet 32 is corrugated (the corrugations preferably would run parallel to the direction of curvature of the underside of the panel), then the spacing means can be eliminated since the valleys in the corrugated perforated sheet can serve as channels to conduct away the water drawn up through the perforated sheet. In any case, if the perforated sheet does press upwards against the rest of the panel because the sheet is stressed laterally in compression, then the underside of the cooling panel must be at least slightly concave.

When employing a type of construction for a cooling panel in which the underside of the panel is generally concave and the perforated sheet is in a state of compression, the surface of the perforated sheet may approximate that of a section of the surface of a cylinder or it may approximate that of a section of the surface of a sphere. In the first case it will be arch shaped and in the second dome shaped. Both shapes can be effective in causing the perforated sheet to press firmly against the spacing means above it. Although rigid spacing means such as the spacing means 34 shown in the FIG. 3 panel can be quite effective in transferring heat from the perforated sheet to the cold plate, springy spacing means such as the undulating spacing sheet 24 can be even more effective in transferring this heat since the springy spacing means is capable of sustaining positive contact with the perforated sheet. When springy spacing means are not employed, then an effort should at least be made to employ resilient end strips. The end strips 36, for example, should preferably be slightly resilient.

The underside of thermal spacing means 34 should be slightly roughened so that even though the spacing means block many of the perforations 37 water can still seep up through these perforations and be drawn away laterally along the roughened surface to one of the channels 35. Thus the spacing means can make good thermal contact with the perforated sheet yet still allow water to seep up through the perforations in the area where the spacing means thermally contacts the perforated sheet. This same phenomenon can be employed in the other panels illustrated or disclosed herein. Water can seep up through a perforation at the very point where the perforated sheet is in thermal contact with the cold plate—either directly to the cold plate or via a spacing member.

One important advantage in employing a type of construction for a cooling panel in which bonding means such as bonding agents or welds are not required between the perforated sheet and the cold plate in the broad central area of the panel is that there is then no danger of any of the perforations in the perforated sheet being blocked by the bonding agents. This aspect of the invention which avoids the danger of the blocking of the perforations by bonding agents can be quite important since it can be a difficult problem to satisfactorily bond a perforated sheet to the spacing members, or if the perforated sheet is corrugated, to bond the corrugated sheet directly to the cold plate without blocking many of the perforations. The water absorbing effectiveness of a cooling panel is increased when the perforations in the perforated sheet are spaced quite close to each other. With close spacing, it can be unusually difficult to avoid sealing over many of the perforations with the bonding agent.

Instead of mechanically stressing the perforated sheet in a manner to cause it to press in an upwards direction, the perforated sheet and other members of the panel above the perforated sheet may be composed of a magnetic material which if suitably magnetized will cause the perforated sheet to be attracted toward the cold plate and thus cause the perforated sheet and cold plate to press tightly against the spacing means when such spacing means are used. When water in the inner passageways of the panel freezes, the ice may force the perforated sheet slightly downward but when that ice thaws the perforated sheet will return to its original position. In this type of construction bonding agents are again no longer necessary.

Actually the mild suction in the inner passageways of a panel can be sufficient to cause the panel's perforated sheet to press up against the spacing means with at least a mild pressure so that the perforated sheet is held in thermal contact with the cold plate. This upward pressure caused by the mild suction force within the panel will not be nearly as great or effective an upward pressure as that caused by the aforementioned magnetic forces or by the lateral tension or compressive stress forces induced in a perforated sheet as previously discussed. Nevertheless the mild suction within the panel produced by the suction pumping means can if properly employed permit a cooling panel to be built and operated with some degree of usefulness without employing bonding agents to hold the perforated plate in position. During the freeze-defrost cycles of a cooling panel the suction pump is usually activated only during the defrost or thaw portion of the cycle and then turned off during the freeze period. However when relying on the suction in the panel to cause the perforated sheet to make a good thermal contact with the cold plate it is important that the suction pumping be continued through at least a portion of the freeze period. The suction should be maintained up until the time that the moisture inside the panel has frozen. After the thaw period in a panel some moisture always remains in the panel. The suction pump can remove most of the water in the inner passageways of the panel but a small amount of water always remains behind. Some of it is trapped in the very fine capillary crevasses that exist, for example, between the perforated sheet and the spacing means 34 in the FIG. 3 panel. Once this moisture has frozen, the suction pump may be shut off because the perforated sheet is now locked into position by the frozen moisture. This frozen moisture will act as a bonding agent but with the important distinction that the frozen moisture will not permanently seal over the perforations but will melt during the thaw period thereby unplugging any blocked perforations.

Figure 5:
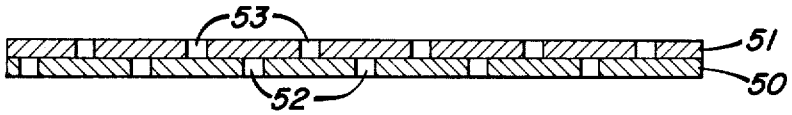
FIG. 5 depicts a cross-sectional view in elevation of a portion of one embodiment of the outer capillary system.

In the panels so far discussed the porous layer on which the moisture from the air condenses is preferably a perforated sheet. Although this perforated sheet normally is a single sheet, it could be a compound sheet consisting of two perforated sheets in close contact with one another. FIG. 5 shows a small cutaway portion of two such sheets. The lower perforated sheet 50 is the outer sheet on which the moisture from the ambient air condenses. Sheet 50 presses upwardly against a second perforated sheet 51. This second sheet is purposely positioned in a manner whereby the perforations 53 in this second sheet are not directly over the perforations 52 in the first sheet. Then condensate water which is drawn up through the holes 52 must move laterally between the two sheets until it encounters a nearby hole in the array of holes 53 in the second sheet where it can be drawn up into the panel and discharged through the discharge tube. If the surfaces between the two sheets 50 and 51 are slightly roughened then there will be no difficulty in water seeping laterally along these surfaces. These surfaces as well as the interior surfaces of the perforations in the two sheets may be suitably treated chemically or otherwise treated with some thin wettable coating to enhance the wettability of the surfaces. The bottom perforated sheet 50 can be held tightly against the upper sheet 51 according to any of the methods previously discussed to cause it to press firmly in an upwards direction.

One of the advantages in employing a double or compound perforated sheet arrangement is that the holes in the sheet can now be made larger and also more uniform in size. This can considerably reduce the manufacturing costs and increase the reliability of the perforated sheet. The production of a perforated metallic sheet containing very small holes relatively uniform in size can be quite expensive. The very thin lateral capillary pathways between the two sheets 50 and 51 can be made unusually thin thereby enabling very strong and effective water seals to be maintained, when so desired, in these thin capillary pathways.

A spacing sheet is referred to in this application as a spacing sheet and not a perforated sheet even though the spacing sheet may be punctured with holes. The term "perforated sheet" will be reserved for the outside sheet of the panel on which the moisture condenses except for the case of a compound perforated sheet where each of the sheets in the combination will be termed a perforated sheet. The outside face of a simple or compound perforated sheet on which the moisture condenses may of course be coated with a thin layer of paint particularly a porous paint or plastic with the moisture condensing onto this paint layer.

When it is stated that the perforated sheet in its broad central cooling area is unattached to the cold plate it means either directly to the cold plate or via a spacing sheet or other spacing means.

A very important aspect of this invention is its teaching of how the panel's perforated sheet can be caused to make good thermal contact with the cold plate even though the perforated sheet, if attached to the panel, is fastened thereto only at the sheet's edges whereby the broad central area of the perforated sheet is unattached to the portions of the panel directly above it. The expansive forces of the freezing water, therefore, can move the perforated sheet downward slightly without rupturing any bonds holding the panel together since there are no bonds in the broad central area of the panel where practically all the cooling takes place. When the ice thaws the perforated sheet returns to its original position. Also in all of these central areas of the panel, the water directly above the perforated sheet is free to move laterally. This lateral movement may be only a seepage but still it is motion. Thus it is immaterial if the perforations in the perforated sheet are blocked by any portion of the thermal spacing means or the cold plate itself since water can still be drawn up through a blocked perforation and caused by the suction within the panel to seep laterally between the perforated sheet and the blocking thermal conduction member. This is the case in the FIG. 3 panel and also in all the other panels shown where no care need be taken to position the perforations in the perforated sheet in a manner whereby the perforations are not blocked by any thermal conducting member that touches the perforated sheet.

In addition to the technique of stressing a perforated sheet by stretching it across the curved lower surface of the cooling panel to thereby cause it to forcefully push in an upwards direction there is still another method of mechanically stressing this perforated sheet in a manner to cause it to have an upwards thrust. If the perforated sheet when unattached to the rest of the panel has a smooth but pronounced natural curvature such as the curvature that exists in a section of the surface of a cylinder, then when this perforated sheet is pressed upwards against a corrugated or dimpled spacing sheet with the convex side of the perforated sheet being against the spacing sheet and if the four edges of the perforated sheet are then clamped or otherwise secured to a relatively flat panel then the entire perforated sheet will press against the spacing sheet and be in good thermal contact with the spacing sheet and cold plate. A curved perforated sheet that has been flattened in this manner can be considered to be a prestressed sheet with the outer surface of the sheet stressed in tension and the inner surface in compression. A normal flat sheet is not prestressed. One advantage of this prestressed type of construction is that the entire panel can, if desired, be made flat. This prestressed type of mechanical stressing technique works best on small panels or other panels in which the attachment points between the perforated sheet and the cold plate are not widely separated from each other.

In the fabrication of a cooling panel a few spots of glue might conceivably be applied here and there to the central areas of the spacing sheet, or the perforated sheet or the cold plate to aid in properly positioning these members relative to one another prior to their assembly into the completed panel. In this case the broad central cooling area of the perforated sheet is still mostly unattached to the other portions of the panel above it. The very small areas occupied by the few scattered spots of glue are small compared to the remaining large areas of the perforated sheet that are not glued and which would not make good thermal contact with the cold plate were it not for the existence of other forces such as the mechanical stress forces previously discussed.

In addition to the glue spots one might conceivably for one reason or another insert several screws in the central cooling area of the perforated sheet which would attach those points of the perforated sheet where the screws were inserted to the cold plate. These screws might be composed of a resilient material to withstand the expansive forces of freezing water, or the screws might have small resilient rubber washers on their heads. However these screws are generally undesireable partly because their protruding heads become drip points for the condensate water and partly because the protruding heads destroy the esthetic appeal of the broad smooth even undersurface of a panel. Nevertheless if because of a few screws or a few spots of glue there are a few attachment points on the broad central cooling area of the perforated sheet these attachment points will attach only a small fraction of the total area of the perforated sheet to the cold plate. By far the greatest portion of the broad central cooling area of the perforated sheet (perhaps 90% of this area) would be unattached and some stress forces must be relied upon to cause these unattached portions to make a reasonably good thermal contact with the cold plate.

The term "mechanical stress" or "mechanically stressed" is intended to include the stresses that arise from mechanically pushing or pulling on the thin perforated sheet. The perforated sheet after being stressed by pulling or pushing is then normally firmly secured around its edges to the other parts of the panel so as to cause the sheet to retain its mechanically induced stress. This mechanical stress term does not include the stresses that arise from magnetic forces or simple suction forces although the stresses arising from either magnetic or suction forces may also be present in addition to the aforementioned mechanical stresses. In the panels illustrated in FIGS. 1, 2, 3 and 4 the perforated sheets are mechanically stressed and it is these mechanical stresses that cause the perforated sheets to be forced toward the cold plate. A prestressed perforated sheet is another example of a mechanically stressed perforated sheet.

The mechanical stressing as outlined in this application refers to the stressing of thin perforated sheets and not thick sheets. The stressing of thin sheets requires special stressing techniques whereas the stressing of thick sheets does not. A thick perforated sheet, say a flat steel perforated sheet with a thickness of ¼" or ½" will because of its rigidity automatically transmit in almost full strength to the central areas of the sheet any upward pressures exerted on the edges of the sheet. Thus in placing this thick perforated sheet against a springy spacing sheet on the underside of a panel and pressing upwards on the edges of the thick sheet the central areas of the thick perforated sheet will also press upwards with this same pressure and make good contact with the springy spacing sheet. No curvature of the thick sheet is necessary as a prerequisite for producing a strong upward thrust in the central areas of the thick sheet. When employing a thin perforated sheet (thin sheets tend to have very little rigidity) more sophisticated mounting and stressing techniques are required. It is very difficult to cause forces applied to the edges or any other attachment points of a thin perforated sheet to be transmitted to the unattached areas of the sheet in a manner whereby these unattached areas will be pushed upward unless one works with sheets having curvatures or employs other special techniques. More than simple brute force methods are needed to cause these unattached areas to have a useful upward thrust.

As mentioned previously the suction forces in the inner passageways of a panel may be utilized to cause a perforated sheet unattached to the other portions of the panel except for around its edges to be pulled toward the cold plate and make thermal contact with the cold plate. When the stress due to these suction forces is depended upon to cause this thermal contact to be made then the suction should at least be strong enough to pull up the perforated sheet toward the cold plate and the perforated sheet should be thin and light enough so it can be pulled up. Ordinarily for most panels the suction in the panel must be limited in strength to a mild suction to avoid breaking all the water seals in the perforations of the perforated sheet and allowing an excessive amount of air to enter the panel. With this limitation on the permissible degree of suction it is particularly important to have the perforated sheet thin and light in weight. Another requirement is that the perforated sheet have a reasonable degree of flexibility to enable it to conform to the broad contours of the other portions of the panel above it and contact these portions. A cold plate in a refrigerator is not a finely machined plate but usually consists of an ordinary aluminum sheet that may be somewhat warped and uneven. A thin flexible perforated sheet can to a reasonable degree conform to the contours of this uneven surface of the cold plate or any spacing members between the cold plate and the perforated sheet and by conforming to these contours make good thermal contact with the cold plate even though the suction force pulling the perforated sheet toward the cold plate is relatively mild. Spacing members when employed should preferably also be flexible. An undulating spacing sheet is an example of flexible spacing means. If the spacing means is very flexible then the perforated sheet need not be so flexible. It is the combination of the perforated sheet and the other portions of the panel above it such as the spacing means that must have some flexibility. One of the reasons for employing a perforated sheet that is thin is that a thin sheet is more flexible than a thicker sheet. As an example of this need for flexibility attention is called to the FIG. 3 panel. If a commercial refrigerator were built that utilized the FIG. 3 panel the underside of the spacing means would seldom be as smooth and even as that shown. If this panel were constructed as a relatively flat panel instead of being arched then the surface envelope formed by the lower faces of all the spacing members would in any commercial panel not be very flat or even but would have many "high" and "low" points. If suction forces were the stress forces that were relied upon to pull the perforated sheet up against the spacing members then it would be found that the perforated sheet if unduely rigid would not make a uniform even contact with all the spacing members but would touch the spacing members only on some scattered "high" points. The thinner and more flexible the perforated sheet the more uniformly it will contact all the spacing members and thus the better thermal contact it will make with the cold plate. By way of example a perforated sheet having a thickness in the neighborhood of 0.01 or 0.02 of an inch can be considered for panel purposes to be thin enough to have a reasonable flexibility whereas a sheet 0.05 or 0.10 of an inch thick will be too thick and rigid to be useful in a panel that relies on suction forces to pull the sheet toward the cold plate. The composition of the sheet of course also makes a difference. These thickness figures refer to a perforated sheet without protrusions, or if there are protrusions it is the thinnest portion of the sheet that is being referred to. Mechanically stressed perforated sheets should of course also be thin. However more leeway in the thickness dimension is permitted for mechanically stressed sheets than for suction stressed sheets.

It is to be pointed out that stressing means other than suction stressing means can be considerably stronger and more effective in causing the perforated sheet to be forced towards the cold plate. Mechanical stressing means such as previously outlined are an example of such forceful stressing means. Whenever possible one should try to employ mechanical stressing means rather than relying on simple suction stressing means.

Figure 6:
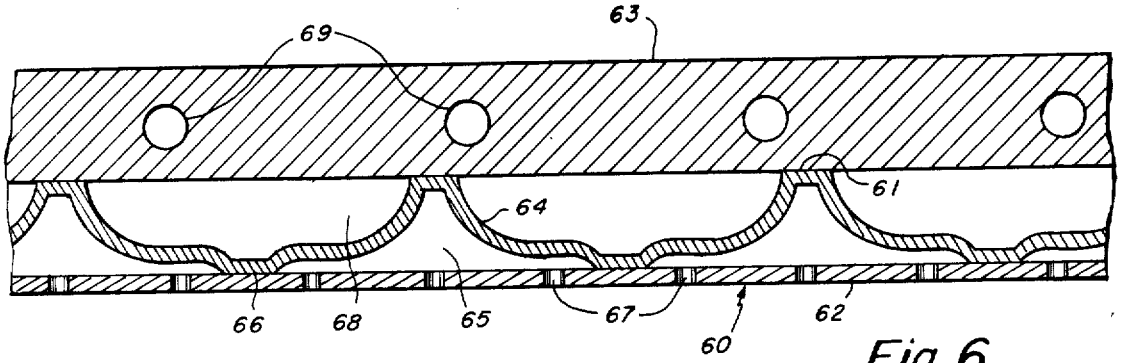
FIG. 6 depicts a cross-sectional view in elevation of another embodiment of the cooling panel.

FIG. 6 shows a panel 60 which is a variation of the panel depicted in FIG. 2. In the FIG. 6 arrangement, a springy metallic spacing sheet 64 is sandwiched between the cold plate 63 and the perforated sheet 62 having perforations 67. Conduits 69 in the cold plate 63 carry refrigerant for cooling the cold plate. The crests or ridge tops 61 in the springy sheet 64 are firmly soldered, welded, or otherwise securely bonded to the underside of the cold plate. The bottoms of the troughs 66 in the springy sheet 64 are perferably also firmly soldered, welded or otherwise securely bonded to the upper surface of the perforated sheet 62. The springy sheet 64 divides the space between the cold plate and the perforated sheet into two sets of channels, an upper and a lower set. The lower set of channels 65 are discharge channels into which condensate water is sucked up from the inderside of the perforated sheet 62 through perforations 67. These discharge channels carry the water to one end of the panel to a discharge tube that conduits this discharge water away from the panel. A suction means should be provided for creating a mild suction in the discharge channels 65. The upper channels 68 are essentially dead air zones that are completely isolated from the water in the lower channels 66. Thus when water in the lower channels freezes, it presses against the springy sheet 64 and causes this springy sheet to flex into the upper dead air channels. Thus the expansive pressure of the freezing water in the lower channels will be relieved and the solder bonds between the springy sheet and perforated sheet will not rupture. With this construction it is unnecessary to have the underside of the panel 60 curved, such as in the panels 1, 20 and 30, to permit lateral tensile or compressive forces to be utilized to keep the perforated sheet in firm contact with the springy sheet 64. If no provision is made for firmly bonding the perforated sheet to the springy sheet then other forces such as lateral tensile or compressive forces acting on a curved perforated sheet should be provided for.

As shown in FIG. 6, the undulating springy sheet 64 is shaped in a manner to permit considerable flexing into the upper channels 68. These upper channels are sealed at their ends to prevent any entry of water into them. Instead of soldering each crest and each throgh of the springy sheet 64 only alternate crests and/or troughs or every third or fourth crest and/or trough can be soldered to increase the resiliency of the springy sheet. If the perforated sheet 62 is mechanically stressed or prestressed in a manner to push upward between the soldered attachment points, then there can still be relatively good heat transfer between the cold plate and the perforated sheet even though many of the crests and troughs of the springy sheet are unsoldered.

The undulating springy spacing sheet should be generally coextensive with the cold plate. The shape of the undulations in the springy spacing sheet may vary considerably from those shown in FIG. 6. What is important is that the undulations provide sufficient flexibility to protect the cooling panel from the disruptive forces of freezing water.

Figure 7:
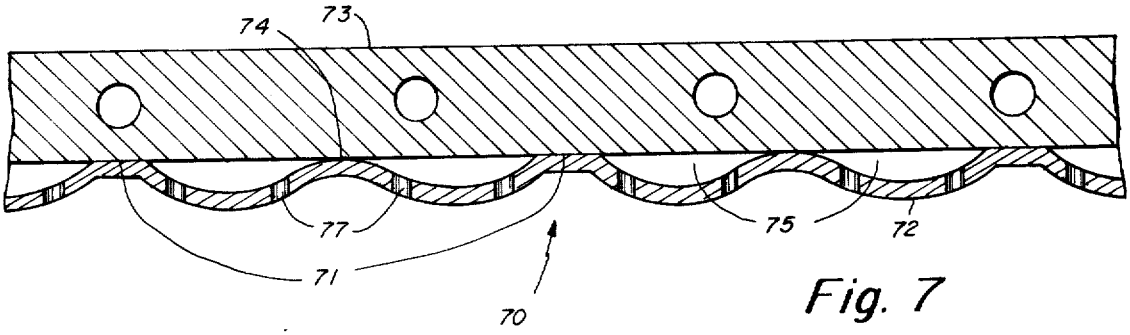
FIG. 7 depicts a cross-sectional view in elevation of still another embodiment of the cooling panel.

FIG. 7 shows a cooling panel 70 which is a variation of the cooling panel depicted in FIG. 4. In the FIG. 7 arrangement, an undulating flexible perforated sheet 72 having perforations 77 is soldered, welded or otherwise firmly affixed at alternate crests 71 of the undulating sheet 72 to the cold plate 73. Preferably the undulations in the undulating sheet 72 form long narrow generally parallel flow channels 75. These flow or discharge channels 75, at their ends, are connected to a discharge tube for conducting away the condensate water that is sucked up through the perforations 77 into the discharge channels 75. The undulating sheet 72 should be flexible and with enough flexible curvatures to permit the non-soldered areas of the sheet 72 to flex downward away from the cold plate when the water in the discharge channels 75 freezes. Then the solder bonds between the alternate crests 71 and the cold plate will not be unduly stressed and will remain intact even after repeated freezing and thawing cycles of the cooling system. The undulating perforated sheet 72 may have other shaped undulations than those shown such as triangular shaped undulations. However between the soldered attachment points 71 there should preferably be an undulation that forms two troughs with an intervening ridge 74. This ridge 74, unattached to the cold plate, is free to flex downward away from the cold plate when the water in the channels 75 freezes. The perforated sheet 72 without this additional ridge 74 between the other two attached ridges 71 would be much less springy and might not adequately protect the soldered attachment points 71 from the expansive forces of the freezing water. Between the attachment points 71 there may be more than one unattached ridge. The perforated sheet 72 may be prestressed or otherwise mechanically stressed so as to cause the unattached ridges between the attachment points to press upward against the cold plate thus increasing the thermal conduction between the cold plate and the perforated sheet. The term "crest" or "ridge" is here used to mean the portions of the undulating perforated sheet 72 or undulating spacing sheet 64 that are closest to the cold plate.

There are still other advantages in employing an undulating perforated sheet such as in the FIG. 7 type of construction. At the attachment points where the perforated sheet is soldered to the cold plate, the perforated sheet is impervious to the passage of condensate water because of the blockage formed by the solder. If the solder connections are at the crests of an undulating perforated sheet that is situated on the underside of a horizontal panel, then any droplets of water directly under the solder connections will tend to flow laterally and downhill on the underside of the perforated sheet until the droplets contact a perforation where they can be sucked up into the panel. This downward slope that exists on either side of the crests may be quite mild, but even this mild slope will aid in the lateral movement of water away from the area under the solder connection. At the bottom, particularly the very bottom, of the troughs of the undulating perforated sheet, there should be an ample number of perforations to enable water on the underside of these troughs to be rapidly sucked up into the panel. If the perforated sheet on the underside of a horizontal panel were completely flat without any undulations then there would be no gravity forces acting on the water under a solder connection to tend to move this water laterally. In this latter case there is always the danger that large droplets of water under a solder connection will drop off the panel.

When the discharge channels 75 are filled with water and the temperature of the cold plate begins to drop freezing will first occur in the thin layers of water in contact with the lower surface of the cold plate and other contacting metallic surfaces. The water in the vicinity of the solder joints at the top of the crests 71 will freeze sooner than the main masses of water in the interior of the discharge channels. As the ice builds up at these solder joints, it will push laterally away from the solder joints. This expansion of the ice in a lateral rather than in a predominately vertical direction is possible because the perforated sheet slopes downward away from the area of the solder joints. Because of the divergence of the channels in a direction away from the solder joints, the water in beginning to freeze around the solder joints will transmit its expansive pressure evenly to the entire channel causing a general downward flexing of the perforated sheet. This downward flexing is small and distributed rather evenly over the entire portion of the perforated sheet between adjacent soldered attachment points rather than concentrated close to the solder joints. With the downward flexing of the perforated sheet therefore being very mild at the solder joints there will be but little stress at the solder joints.

If the perforated sheet instead of being undulating, was flat and parallel to the cold plate and separated therefrom by soldered metallic spacing members, then the ice that formed adjacent to the soldered spacing members could not readily expand laterally into the discharge channels because there would be no divergence of the discharge channels in the vicinity of the solder bonds. There may be air bubbles or other masses of air in the discharge channels to absorb much of the expansion of the ice, but unless these air bubbles are close to the solder bonds there can be a great strain produced in these bonds by the ice. Repeated freezing and thawings of the water in the channels could eventually cause the solder bonds to rupture. The situation is analogous to the freezing of water in a flower vase. The probability of the vase breaking is considerably reduced if the vase is conically rather than cylindrically shaped.

Another reason for having at least one unsoldered crest, such as crest 74, between adjacent soldered crests 71 is that this unsoldered crest aids in the conduction of heat between the cold plate and the areas of the perforated sheet that are far removed from the soldered crests. These soldered crests can also be referred to as soldered attachment points or simply solder points. Even though the thermal conductivity of ice is only about 1% as great as that of aluminum, more heat can actually be removed from the areas of the perforated sheet that are near the unsoldered crest 74 in a vertical direction through the thin ice film separating the crest 74 and the cold plate than can be removed in a lateral direction along the metallic perforated sheet to the solder points 71. This is because the rate at which heat can be conducted through a block of any material is proportional to the cross-sectional area of the block perpendicular to the direction of the heat flow and inversely proportional to the thickness of the block in the direction of the heat flow. A perforated sheet even though composed of aluminum will because of its thinness be only a fair conductor of heat in a lateral direction. Thus the areas of the perforated sheet generally midway between solder points can lose heat more rapidly in a vertical than a lateral direction. If one divides the distance between solder points into thirds with the areas of the perforated sheet occupied by each third being a zone, then the first and third zones would be adjacent to the solder points and the second or middle or central zone or area would be midway between solder points. The unsoldered crest 74 of the perforated sheet should be near this broad central zone of the perforated sheet so as to enable significant quantities of heat to be conducted away from this central zone in a vertical direction.

It is not necessary that the unsoldered crest 74 touch the cold plate although usually it will touch the cold plate at scattered points. An unsoldered crest reasonably close to the cold plate will insure that significant quantities of heat will be conducted away vertically through the intervening ice film. Thus an undulating perforated sheet will cause the discharge space above it to be divided into thick discharge channels in the vicinity of the troughs and thin discharge channels in the vicinity of the unsoldered crests.

In general there should not be too many soldered or other attachment points between the perforated sheet of a cooling panel and the cold plate since these attachment points generally tend to block adjacent perforations and thus reduce the effectiveness of the perforated sheet. The farther apart these attachment points are the more desireable it is to have between the attachment points one or more unsoldered crests with their associated thin discharge channel spaces. For greater effectiveness these unsoldered crests might be quite broad. What is important is that between the attachment points there be adequate thin channels interspersed with thick channels.

One of the advantages of having a discharge channel system that includes thick as well as thin channels is that the thick channels are much freer of blockage from small air bubbles or larger pockets of air entrapped in the condensate water in the discharge channel. These air bubbles because of their surface tension tend to stick to the walls of a channel and can completely block a channel particularly if there are many such bubbles or larger air pockets in series along a channel. However with thicker channels this stickiness is less pronounced and the blocking tendencies of the bubbles will not be such a serious problem. Thus with thicker channels interspersed with the thinner channels applied suction forces, even mild suction forces, can be effective in reaching to all areas of the perforated sheet and readily draw up the condensate water on the entire underside of the perforated sheet.

The term "thin channels" or "thin channel space" may refer to very short channels as well as longer channels. The "thin channel space" need only be long enough to conduct water laterally from the exit ends of those perforations that exist in an unsoldered crest area to a trough area where there is thick channel space. The thick channel space may be very long, such as the length of the cooling panel, whereas the thin channel space may, for example, be as short as ¼ of an inch.

Panel 60 as shown in FIG. 6 is somewhat similar to panel 70 in FIG. 7 in that the discharge channels 65 above the perforated sheet 62 include both thick and thin discharge channel spaces. If not all the troughs 66 were soldered to the perforated sheet but only alternate troughs or every third trough were soldered to the perforated sheet then the thin discharge channel space would be accentuated since directly beneath each unsoldered trough there would be a very thin discharge channel space. The thin ice film that would form beneath each unsoldered trough would permit heat to readily flow upward from opposite areas of the perforated sheet. Thus those areas of the perforated sheet that are at a considerable distance from the soldered areas of the perforated sheet would readily be cooled by a vertical conduction of heat. The thick channel space interspersed with the thin channel space is again necessary to prevent air bubbles from completely blocking the suction forces. The thin channel space can of course be very short.

The dead air space 68 may be used for other purposes than simply a dead air space. For example, a cold refrigerating fluid or other cold fluid may be caused to flow through these spaces 68 to thereby cool the cold panel. This is generally undesirable because in most cold fluid cooling systems the cold fluid is supplied under considerable pressure. This pressure might rupture the solder joints 61 or at least necessitate considerably increasing the thickness of the undulating sheet 64. Since this undulating sheet 64 is supposed to be flexible a thick undulating sheet would be quite undesireable.

A small fan may, if desired, be mounted inside the freezer compartment of a refrigerator to circulate the air within the compartment. When the fan is turned on any frost that has collected on the non-cooling surfaces in the freezer compartment will be slowly evaporated by the circulating cold dry air and redeposited as frost on the compartment's cooling panel. When air is circulated inside any closed system moisture tends to be evaporated from the warmer surfaces and redeposited on the colder surfaces.

In circulating the air within the compartment the fan should be caused to blow the air past most of the surfaces within the compartment which are not part of the cooling system but which also tend to accumulate frost. Then at least some of this moisture containing air should be caused to flow adjacent to the exposed surfaces of the cooling panel so that the moisture in the air can be deposited on the very cold cooling panel. The fan may be programmed to turn on for a period of about one day or even several days before the beginning of the defrost cycle in the cooling panel and turned off once the defrost cycle starts. The defrosting of the cooling panel by applying heat to the panel should preferably commence soon after the termination of the fan operation. While a moderate delay in the start of this defrosting of the panel is harmless, some impairment of efficiency will result if a substantial delay is permitted to occur. The purpose in programming the fan in this manner is to cause the accelerated buildup of frost on the cooling panel caused by the fan to occur just prior to the defrost cycle when all the frost on the cooling panel will be removed. The efficiency of a cooling panel is greatest when the panel is free of heavy frost deposits. Thus after the defrost cycle the cooling panel will operate at high efficiency for many weeks. During this period there will be no accelerated building up of frost on the panel due to a prolonged forced circulation of air in the compartment by the fan. When the fan is finally turned on for a prolonged period it should preferably be caused to operate long enough to remove at least a sizeable portion of the frost that has collected on the non-cooling surfaces.

The defrosting of a cooling panel is accomplished by applying heat internally to the panel to thereby melt the accumulated frost on its surface. This may be accomplished by flowing electric current through electric resistance wires within the panel or preferably by employing a defrost valve.

Many of the present day forced or flash defrost freezers of the type where heat is applied to the cooling unit for defrosting purposes incorporate a defrost valve in the evaporator-condenser cooling system. This valve may be located just before and in series with the evaporator. When the valve is almost closed it becomes an expansion valve and causes the refrigerating fluid from the condenser to suddenly expand and cool the evaporator. When the valve is wide open this expansion can not take place and the evaporator heats up. A shunt valve across the condenser may also be used. This shunt valve should be located on the exit side of the compressor and causes the refrigerant fluid leaving the compressor to by-pass the condenser and enter the evaporator directly. Thus the fluid circulates around and around between the evaporator and compressor becoming warmer as it does so because of frictional forces. Since the condenser is by-passed it is unable to dissipate the heat of the fluid and the temperature of the fluid rises. This warm fluid circulating in the evaporator warms the exposed surfaces of the evaporator and melts any accumulated frost condensate. After this defrosting step is completed the shunt valve is caused to be closed and the refrigerant fluid once again circulates from the compressor through the condenser and then to the evaporator. Since the heat in the compressed fluid can now be dissipated by the condenser the fluid entering and expanding into the evaporator will become very cold and exert its normal refrigerating action. The shunt valve is normally actuated by an electrically controlled electromagnet.

The programming of the defrosting of a cooling panel in conjunction with the activation of an air circulating fan inside a freezer compartment may be accomplished by the incorporation in the freezing unit of a programmed timer or sequencer which may be a simple rotary timing mechanism or it may even be a very rudimentary computer. These devices are well known in the art.

Figure 8:
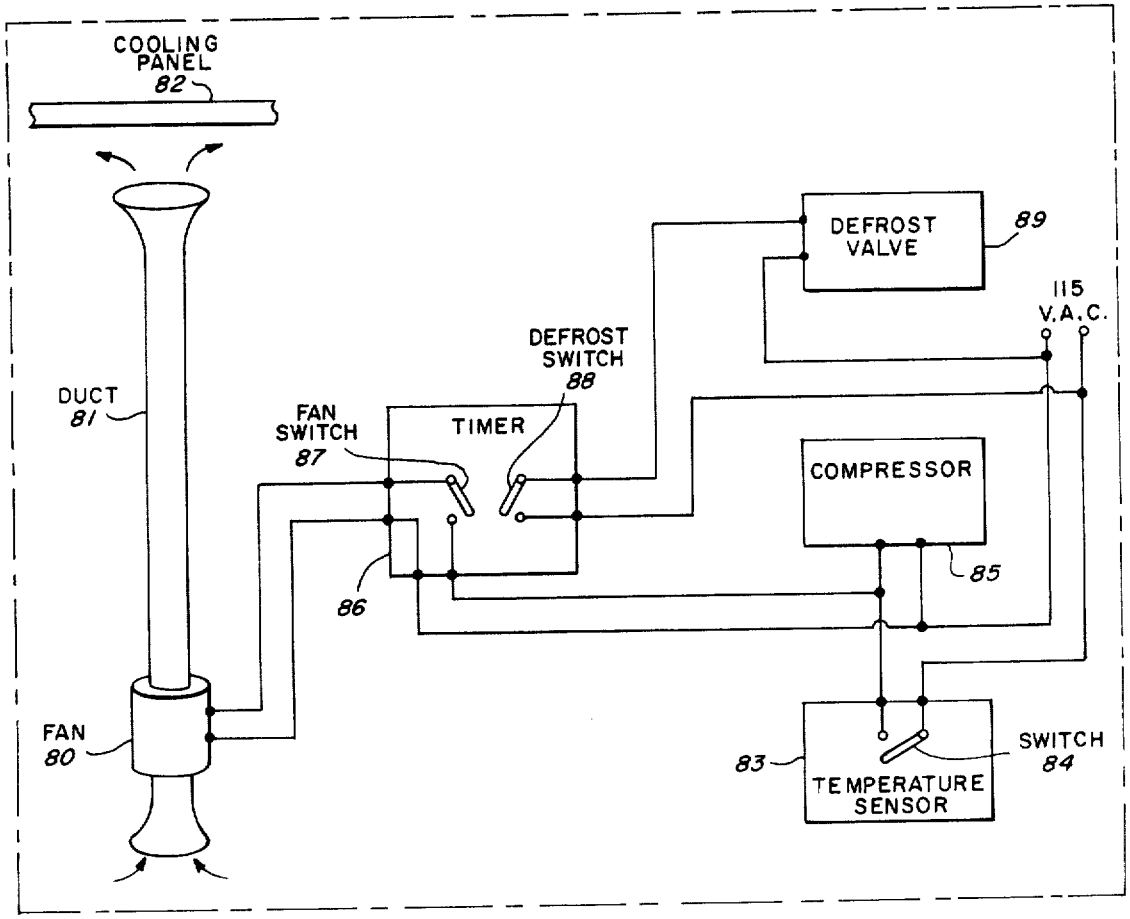
FIG. 8 shows the scheme of an arrangement for circulating cold dry air within a freezer compartment according to a preestablished program.

FIG. 8 illustrates schematically how this air circulating and defrosting sequence can be accomplished. A fan 80 blowing through a vertical duct 81 transfers air from the lower to the upper portion of a freezer compartment. The exit end of the duct 81 directs the flow of air against the condensate absorbing surface of a cooling panel 82 that is mounted on the inside top surface of the freezer compartment. This cooling panel 82 may be similar to the cooling panels previously discussed. Since the air from the duct comes close to the cooling surface of the cooling panel any moisture in the air will condense on the cooling surface. Although the flow of air in the ducts should preferably be in an upward direction it may, by reversing the fan, be caused to flow in a downward direction. In either case air in the lower as well as other portions of the freezer will be caused to eventually flow near to the panel's cooling surface whereby some of the moisture in the air will be trapped by the very cold cooling surface. Although the duct 81 is shown as a relatively long duct it can be considerably shorter provided the fan is able to circulate the air past a cooling panel.

In addition to the fan and duct the freezer includes, as shown in FIG. 8, a temperature sensor 83 along with its on-off electrical switch 84, a compressor 85, a defrost by-pass valve 89 and a programmed timer or sequencer 86 having clockwork operated time delay switches for opening and closing electrical circuits at programmed intervals. Two of these sequencer switches are shown: a fan switch 87 and a defrost switch 88. The sequencer may be powered by the conventional 115 volt power lines. The temperature sensor 83 which may be located within the freezer compartment activates the compressor by closing the circuit connecting it to a 115 volt supply line whenever the temperature in the freezer rises to a predetermined value. After the compressor has been running for about five minutes and the cooling panel is very cold, the sequencer may if desired cause the fan switch to be closed for a short interval of time, say three minutes, so as to cause the fan to circulate the very cold air adjacent the cooling panel around all the food packages in the freezer compartment. After this three minute period of forced circulation to hasten the cooling, the normal convection currents in the freezer will be sufficient to maintain the food packages cold. The sequencer should preferably also be programmed to initiate a defrost cycle lasting for a period of approximately twenty minutes with said defrosting being programmed to occur about once a month or as needed. For a period of about twenty-four hours or even several days prior to the initiation of this defrosting step however the sequencer should be programmed to cause the fan to run essentially whenever the compressor is running. Actually during this twenty-four hour period the fan should not be run in exact concurrence with the running of the compressor. After each time that the compressor is turned on during this twenty-four hour time period there should be a delay period of about five minutes before the fan is turned on to insure that the cooling panel will be very cold when the fan is circulating air around the freezer compartment. However the fan should be turned off at about the same time that the compressor is turned off but a few minutes leeway between these turn off times is permissible. The various time periods given in this description of the operation of the freezer, such as the twenty-four hour time period, are intended of course to be considered only as examples. The twenty-four hour time period may for example be several days. The optimum time periods depend upon the ambient humidity and temperature conditions, the frequency of freezer door openings, etc. If conditions are such that defrosting periods can be very infrequent then a manually operated button may be employed to start up the sequencer which will initiate and control a defrost cycle including the prior activation of the fan.

Figure 9:
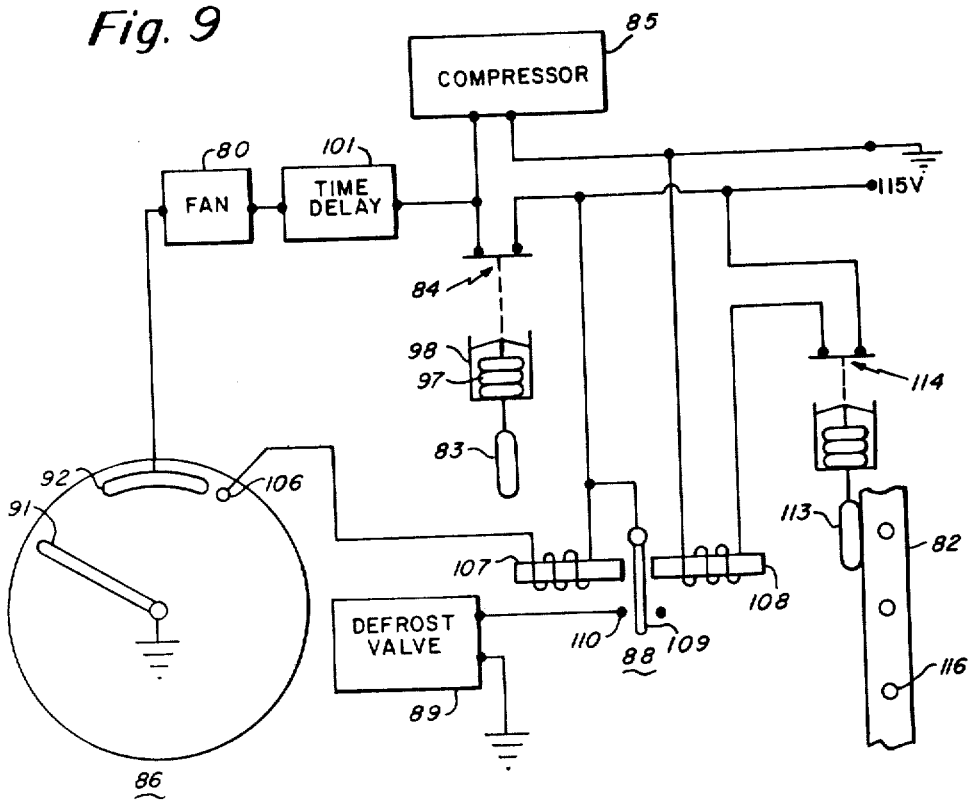
FIG. 9 shows electrical circuit details of the arrangement schematically shown in FIG. 8.

In FIG. 9 there is shown the sequencer 86 having a rotating switching arm 91 which is grounded. A clock mechanism causes this arm 91 to rotate at a constant rate of speed in a clockwise direction at the rate of say 1 revolution every two weeks. An electrode 92 on the rim of the sequencer may have a circumferential length, by way of example, of about 1/14 of the circumference of the sequencer so that when the rotating arm contacts the electrode the arm will remain in contact with it for about 24 hours. Thus one day out of every 14 days the rotating arm is in contact with the electrode 92. This electrode 92 is electrically connected to the fan 80 and from there through a time delay 101 and a thermostatic switch member 84 to a 115 volt supply line. The switch 84 is controlled by a thermostatic sensing bulb 83 located in the interior of the freezer compartment or if the refrigerating unit is a combination refrigerator-freezer then the thermostatic bulb might instead be located in the interior of the fresh food refrigerator compartment. When the temperature of the bulb 83 rises above an acceptable refrigerating temperature it causes the bellows 97 to expand which in turn causes a toggle snap action device 98 to move the switch 84 to its upper closed position. This switch controls both the fan 80 and the compressor 85. When the switch 84 is in its closed position the compressor and fan are connected to the 115 volt supply terminal. This causes the compressor to be turned on thereby sending very cold refrigerating fluid through the refrigerating coils or other cooling members in the freezer such as the cooling panel 82. The closing of the switch 84 also causes the fan to be turned on but only at those times when the rotating arm 91 is in contact with the electrode 92. A time delay 101 may if desired be inserted in the fan circuit as shown. The use of the time delay 101 insures that the cooling plate in the freezer is at almost maximum coldness when the fan is turned on. The time delay may have a delay period of about 5–10 minutes. This allows time for the refrigerating fluid to thoroughly cool the freezer's cooling panel before the fan is turned on. Also this same time delay permits the fan to continue to operate for the 5–10 minute period after the compressor has been turned off and the cooling panel is still very cold. Although this time delay is desirable it is never the less optional. A relatively good over all performance can still be obtained without the time delay, particularly if the compressor's duty cycle "on" time is considerably longer than the delay time of the time delay when such a delay is used.

A relatively long "on time" for the compressor's duty cycle insures that the temperature of the cooling panel when the compressor is running will much of the time be substantially lower than the interior temperature of the freezer and any fan action at that time will cause frost from the interior of the freezer to be deposited on the cooling panel.

A time delay unit can be costly and it may be preferable to sacrifice some of the over all efficiency and performance of the refrigerator-freezer for the sake of lower manufacturing costs. Thus for practical reasons some leeway in the exact timing of the turning on and off of the fan is permitted particularly if less than optimal operating conditions of the freezer can be tolerated.

Shortly after the rotating arm 91 leaves the electrode 92 it will contact the heating cycle electrode 106. This causes the electromagnet 107 which is part of a flip-flop defrost switch 88 to be energized and to pull the switching vane 109 over to the electrical contact 110 which is the "on" position for the switch. The residual magnetism in the electromagnet 107 causes the vane to remain in contact with the electrical contact 110 even when the electromagnet 107 is no longer energized. With the switch 88 in the "on" position the defrost valve 89 will be activated thereby causing the compressor 85 when it is running to send hot fluid into the "cooling" panel 82 of the freezer. As the cooling panel heats up it will not only melt the frost on its surface but will also heat up the thermostatic bulb 113 which is attached to and in contact with the cooling panel. A schematic cut-away sketch of the cooling panel 82 including ducts 116 for the passage of the refrigerating fluid is shown in contact with the thermostatic bulb 113. Actually the bulb 113 may be slightly separated from the cooling panel 82 by a thin film or layer of insulation so that the bulb does not heat up too rapidly. The bulb 113 when warm causes the switch member 114 to close thereby energizing the electromagnet 108 in the flip-flop switch 88 and causing the switching vane 109 to break away from the electrical contact 110 to the right side "off" position of the switch 88 where it remains because of the residual magnetism in the electromagnet 108 until a much later time when the electromagnet 107 is again energized. As the switch 88 moves to the "off" position defrost valve 89 will be deactivated and the compressor will now once again send cooling fluid into the cooling panel.

The steps of defrosting can be carried out manually using manually operated switches instead of a sequencer. For example, after two weeks of refrigeration the fan can be turned on for about one day by grounding the electrode 92 by means of a manually operated switch inserted between the electrodes 92 and ground. Then the fan can be turned off by disconnecting the ground and then soon afterwards by means of a simple manual switch the defrosting valve can be activated.

The cooling panel should preferably be mounted on the top ceiling surface of the freezer where it can cool the upper layers of air. As this upper air becomes colder its density increases causing it to descend thereby creating convection currents of air in the freezer. Along the inside side walls of the freezer there may be located a bare uninsulated cooling tube running from the top of the freezer to the bottom for transporting cold refrigerant fluid from the cooling panel on the refrigerator's top surface to the compressor which may be located somewhere beneath the freezer. This connecting cooling tube like the cooling panel will tend to rapidly frost up because of its extreme coldness. As the fan circulates the air around the freezer it will transfer frost from the non-cooling surfaces of the freezer to both the cooling panel and the connecting cooling tube. Actually any vertically oriented cooling surface in a freezer can be made to function reasonably effectively in the defrosting cycles even though its surface does not possess a porous construction for absorbing and carrying away condensate water. For a vertically oriented cooling and defrosting surface gravity can be always relied upon to conduct away condensate water. Thus a freezer can employ both porous and non-porous cooling panels in its construction. As an example, a ceiling mounted cooling panel may be bent down at its edges so as to cover the upper vertical side walls of a freezer. The horizontal or almost horizontal portion of the panel covering the ceiling should of course have a porous surface but it is not that essential that the bent down vertical portions of the panel possess a porous surface if means are provided for gathering up and venting the condensate water that will run down these bent down vertical portions of the panel when the panel is defrosted. Thus the fan may cause some of the air in the freezer to flow closely past the porous horizontal ceiling portion of a cooling panel and the remainder of the air to flow closely past the vertical non-porous side wall portions of the cooling panel. Preferably the fan should cause most of the air to flow past the top porous ceiling portion of the cooling panel because the condensate water on the top porous surface can be removed so efficiently and effectively by the suction within the porous panel.

An undulating sheet as used in the described panels can be very irregularly and unsymetrically shaped. The troughs for example can be differently shaped than the crests and adjacent troughs can be differently shaped from each other. A crest in an undulating sheet may be very wide and relatively flat and its associated trough quite narrow or vice versa with the trough very wide and flat and the crest narrow. Also an undulating sheet may include round dimples as part of the undulations. Also the undulations of the undulating sheets can be much more shallow than indicated in the various figures. For example, the undulating perforated sheet shown in panel 70 may have troughs that are only 1/32 or 1/16 of an inch deep.

The undulating sheet 64 shown in panel 60 has multiple functions. It provides discharge channels 65 above the perforated sheet for the discharging of the condensate water. It also is a barrier sheet separating the water discharge channels 65 from the dead air space 68. This dead air space is preferably a completely dead air space but it may contain a small amount of an extraneous material such as pieces of shredded rubber, for example. Between the pieces of shredded rubber there is still dead air space and it is this dead air that is compressible or is otherwise moveable. The term "dead air" is used instead of simple "air" because essentially the purpose of this air is to serve as a buffer medium. The undulating sheet 64 should be metallic so as to have a high thermal conductivity since heat from the perforated sheet must be conducted through the undulating sheet to reach the cold plate. The use of solder bonds between an undulating sheet such as sheet 64 and areas on the cold plates and perforated sheet that the undulating sheet contacts aids in this heat transfer. An undulating perforated sheet such as sheet 72 should also have a high thermal conductivity.

The heat absorbing cold plate will almost always be a continuous plate but it can be discontinuous such as a heavy grid of some sort. An example of such a grid might be a structure formed by aluminim tubing winding back and forth so as to form a generally flat grid. The tubing would carry the cooling fluid. Although a grid of tubing elements can serve the same function as a continuous plate a distinction is made between the two by referring to a continuous plate as a plate and a grid of tubing elements as a grid. In a typical cooling grid the tubing elements might be ¼ inch in diameter and be separated from one another by 1 or more inches.

Although a cooling panel would find its principle use as a horizontal ceiling panel for a room or refrigerator-freezer compartment it may also be advantageously used in other positions such as on the side of a refrigerator-freezer compartment.

It is emphasized that applicant's method of frost removal is very different from the method used in the conventional "no-frost" freezers or refrigerator-freezers. In the conventional "no-frost" freezer the cooling surfaces along with their associated cold sink (the evaporator) are in a special cooling compartment which is separate from the frozen food compartment where the food is stored. Heat is transferred from the food compartment to the evaporator in the special cooling compartment by means of a fan which is turned on whenever the compressor is running. This fan action is necessary to maintain the temperature of the food at the desired storage temperature, usually zero degrees fahrenheit. This frequent and prolonged operation of the fan consumes energy. In addition, for a transfer of heat to take place between the two compartments the air in the cooling compartment must be cooled by the evaporator substantially below the temperature of the air in the food compartment. Producing this super-coldness consumes additional energy. Also the evaporator cooling surfaces in the cooling compartment must be maintained relatively free of frost deposits to insure a rapid transfer of heat from the fan circulated air to the cooling surfaces. To prevent the frost deposits from becoming any thicker than a thin film the cooling surfaces must be defrosted by the application of heat about once a day. This frequent drastic raising and lowering of the temperature in the cooling chamber again reduces the energy efficiency of the system.

Another disadvantage of the conventional "no-frost" freezers is that they tend to overly dehydrate the stored food producing a condition in the food known as "freezer burn". This excessive dehydration of the food is caused by the frequent and prolonged operation of the fan blowing very cold dry air over the food.

Applicant's freezer as described in this application is essentially also a "no-frost" freezer but because of its novel construction and method of operation it is much more energy efficient than the present conventional "no-frost" freezers or refrigerator-freezers. In addition, because of the limited and judiciously timed operation of the fan in applicant's freezer the food stored in the freezer will not suffer from "freezer burn". Applicant's freezer design and method of operation represent a major advance in the field of "no-frost" freezers and refrigerator-freezers.

Many of the terms used in this application also appear in applicant's U.S. Pat. No. 3,905,203. The meanings of the terms used in this application are intended to be the same as those in U.S. Pat. No. 3,905,203. Thus no attempt is made in this application to redefine terms that have already been defined or clarified in the aforementioned patent. Thus the term "without flowing into the structure to any considerable degree" also applies to those structures in which absolutely no air is admitted into the structure as well as other strucures in which only a very small amount of the air to be cooled enters the structure.

In view of the various ways in which the invention can be embodied, it is not intended that the scope of the invention be restricted to the precise structures illustrated in the drawings or described in the exposition. Rather, it is intended that the scope of the invention be construed in accordance with the appended claims and that within that scope be included only those structures which in essence utilize the inventive concept here disclosed.

What is claimed is:

1. In an air cooling and water condensate removal structure of the type in which the air to be cooled contacts the structure essentially only on its exterior surface without flowing into the structure to any considerable degree so that substantially all of the air remains on the outside of the structure, said structure having:

(1) a heat absorbing cold plate, (2) means for cooling the cold plate, (3) a porous sheet closely adjacent to and covering the broad face of the cold plate but with a thin broad lateral passageway space provided for on the cold plate side of the porous sheet said passageway space communicating with the pores in the porous sheet over the broad area of the porous sheet, (4) a discharge conduit communicating with the thin passageway space to remove water condensate drawn through the porous sheet and into the thin passageway space from the outside exposed face of the porous sheet on which moisture from the cooled air has condensed, the water removal means being separate from the means for cooling the cold plate, (5) suction pumping means communicating with the discharge conduit for producing a reduced pressure in the thin passageway space whereby condensate water is readily drawn into the thin passageway space and discharged into the discharge conduit, the improvement residing in a suction reducing means associated with the discharge conduit and the thin passageway space and located at or near the juncture of the discharge conduit and the thin passageway space for reducing the suction in the thin passageway space.

2. The improved air cooling and water condensate removal structure according to claim 1, wherein the suction reducing means is a suction regulating means.

3. The improved air cooling and water condensate removal structure according to claim 1, wherein the thin porous sheet is a thin perforated sheet having many small perforations with the perforations being so spaced that water which has condensed on the outside surface of the perforated sheet tends to be drawn into the perforations rather than dropping off of the perforated sheet.

4. The improved air cooling and water condensate removal structure according to claim 2, wherein the thin porous sheet is a thin perforated sheet having many small perforations with the perforations being so spaced that water which has condensed on the outside surface of the perforated sheet tends to be drawn into the perforations rather than dropping off of the perforated sheet.

5. In an air cooling and water condensate removal structure of the type in which the air to be cooled contacts the structure essentially only on its exterior surface without flowing into the structure to any considerable degree so that substantially all of the air remains on the outside of the structure, said structure having (1) a heat absorbing cold plate, (2) means for cooling the cold plate, (3) a thin porous sheet that is closely adjacent to and covering the broad face of the cold plate but with a thin broad lateral passageway spaced provided for on the cold plate side of the porous sheet, said passageway space communicating with the pores in the porous sheet over the broad area of the porous sheet, (4) one or more outlets communicating with the thin passageway space to permit water condensate drawn through the porous sheet into the thin passageway space from the outside exposed face of the porous sheet on which moisture from the cooled air has condensed to be drained away, the outlets for draining away the water being separate from the means for cooling the cold plate, (5) suction pumping means communicating with the passageway space for creating a reduced pressure in the thin passageway space whereby condensate water is readily drawn into this thin passageway space, the improvement wherein the thin porous sheet is unattached to the cold plate over much of the broad central cooling area of the porous sheet and the sheet is forced toward the cold plate in the unattached areas whereby the thermal paths between the cold plate and the thin porous sheet are improved.

6. The improved air cooling and water condensate removal structure according to claim 5, wherein the porous sheet is mechanically stressed laterally in tension and the outer surface of the porous sheet is at least slightly convex so that the sheet presses inwardly toward the cold plate.

7. The improved air cooling and water condensate removal structure according to claim 5, wherein the porous sheet is mechanically stressed laterally in compression and the outer surface of the porous sheet is concave so that the sheet presses inwardly toward the cold plate.

8. The improved air cooling and water condensate removal structure according to claim 5, wherein the porous sheet before its mounting onto the main body of the structure having had natural unstrained curvatures which became flattened out upon the mounting of the porous sheet onto the main body of the structure thereby mechanically stressing the porous sheet in a manner to cause the outer surface of the porous sheet to be in a general state of tension and the inner surface of the porous sheet to be in a general state of compression whereby the porous sheet in its unattached areas is forced toward the cold plate.

9. The improved air cooling and water condensate removal structure according to claim 5, wherein the porous sheet is very light and thin and has sufficient flexibility to that the suction within the panel causes the sheet to press inwardly toward the cold plate sufficiently to make reasonably good thermal connections to the cold plate over the broad central cooling area of the porous sheet.

10. The improved air cooling and water condensate removal structure according to claim 5, wherein the porous sheet is magnetically attracted toward the cold plate whereby the porous sheet makes reasonably good thermal connections with the cold plate over the broad central cooling area of the porous sheet.

11. The improved air cooling and water condensate removal structure according to claim 5, wherein The thin porous sheet is a thin perforated sheet having many small perforations with the perforations being so spaced that water which has condensed on the outside surface of the perforated sheet tends to be drawn into the perforations rather than dropping off of the perforated sheet.

12. The improved air cooling and water condensate removal structure according to claim 11, wherein the perforated sheet is mechanically stressed laterally in tension and the outer surface of the perforated sheet is at least slightly convex so that the sheet presses inwardly toward the cold plate.

13. The improved air cooling and water condensate removal structure according to claim 11, wherein the perforated sheet is mechanically stressed laterally in compression and the outer surface of the perforated sheet is concave so that the sheet presses inwardly toward the cold plate.

14. The improved air cooling and water condensate removal structure according to claim 11, wherein the perforated sheet before its mounting onto the main body of the structure having had natural unstrained curvatures which became flattened out upon the mounting of the perforated sheet onto the main body of the structure thereby mechanically stressing the perforated sheet in a manner to cause the outer surface of the perforated sheet to be in a general state of tension and the inner surface of the perforated sheet to be in a general state of compression whereby the perforated sheet in its unattached areas is forced toward the cold plate.

15. The improved air cooling and water condensate removal structure according to claim 11, wherein the perforated sheet is very light and thin and has sufficient flexibility so that the suction within the panel causes the sheet to press inwardly toward the cold plate sufficiently to make reasonably good thermal connections to the cold plate over the broad central cooling area of the perforated sheet.

16. The improved air cooling and water condensate removal structure according to claim 11, wherein the perforated sheet is magnetically attracted toward the cold plate whereby the perforated sheet makes reasonably good thermal connections with the cold plate over the broad central cooling area of the perforated sheet.

17. The improved air cooling and water condensate removal structure according to claim 11, wherein the perforated sheet is a compound perforated sheet comprising two perforated sheets coextensive with one another and in close contact with one another and with many of the perforations in the one sheet not coinciding with the perforations in the second sheet so that substantial amounts of the water that is drawn up through the compound sheet must in the water's passage through the compound sheet seep laterally between the two sheets that comprise the compound sheet.

18. The improved air cooling and water condensate removal structure according to claim 5, wherein the porous sheet is an undulating porous sheet.

19. The improved air cooling and water condensate removal structure according to claim 18, wherein the undulating porous sheet is stressed chiefly in tension and in a direction that is generally lateral to the face of the cold plate.

20. The improved air cooling and water condensate removal structure according to claim 18, wherein the undulating porous sheet is stressed chiefly in compression and in a direction that is generally lateral to the face of the cold plate.

21. The improved air cooling and water condensate removal structure according to claim 11, wherein the perforated sheet is an undulating perforated sheet.

22. The improved air cooling and water condensate removal structure according to claim 21, wherein the undulating perforated sheet is stressed chiefly in tension and in a direction that is generally lateral to the face of the cold plate.

23. The improved air cooling and water condensate removal structure according to claim 21, wherein the perforated sheet is stressed chiefly in compression and in a direction that is generally lateral to the face of the cold plate.

24. The air cooling and water condensate removal structure according to claim 5, wherein the improvement further resides in springy thermally conductive spacing means providing thermal paths between the porous sheet and the cold plate over the broad cooling area of the porous sheet.

25. The air cooling and water condensate removal structure according to claim 11, wherein the improvement further resides in springy thermally conductive spacing means providing thermal paths between the porous sheet and the cold plate over the broad cooling area of the perforated sheet.

26. The air cooling and water condensate removal structure according to claim 5, wherein the improvement further resides in a springy undulating thermally conductive spacing sheet being positioned between the cold plate and the porous sheet.

27. The air cooling and water condensate removal structure according to claim 11, wherein the improvement further resides in a springy undulating thermally conductive spacing sheet being positioned between the cold plate and the perforated sheet.

28. In an air cooling and water condensate removal structure of the type in which the air to be cooled contacts the structure essentially only on its exterior surface without flowing into the structure to any considerable degree so that substantially all of the air remains on the outside of the structure, said structure having:

(1) a heat absorbing cold sink comprising one or more cooling tubes winding back and forth over a broad area, said area tending to be relatively flat, so as to form a broad grid like cold sink with one of the broad sides of the sink providing a cold face, (2) means for removing heat from the cold sink, (3) a thin porous sheet that is closely adjacent to and covering the cold face of the sink and with a thin broad lateral passageway space provided for on the cold face side of the porous sheet, said passageway space communicating with the pores in the porous sheet over the broad area of the porous sheet, (4) one or more outlets communicating with the thin passageway space to permit water condensate drawn through the porous sheet into the thin passageway space from the outside exposed face of the porous sheet on which moisture from the cooled air has condensed to be drained away, the outlets for draining away the water being separate from the means for cooling the cold sink, (5) suction pumping means communicating with the passageway space for creating a reduced pressure in the thin passageway space whereby condensate water is readily drawn into this thin passageway space, the improvement wherein the thin porous sheet is unattached to the cold sink over much of the broad central cooling area of the porous sheet and the sheet is forced toward the cold sink whereby reasonably good thermal connections with the cold sink are made over the broad central cooling area of the porous sheet.

29. The improved air cooling and water condensate removal structure according to claim 28, wherein the porous sheet is mechanically stressed laterally in tension and the outer surface of the porous sheet is at least slightly convex so that the sheet presses inwardly toward the cold sink.

30. The improved air cooling and water condensate removal structure according to claim 28, wherein the porous sheet is mechanically stressed laterally in compression and the outer surface of the porous sheet is concave so that the sheet presses inwardly toward the cold sink.

31. The improved air cooling and water condensate removal structure according to claim 28, wherein the porous sheet before its mounting onto the main body of the structure having had natural unstrained curvatures which became flattened out upon the mounting of the porous sheet onto the main body of the structure thereby mechanically stressing the porous sheet in a manner to cause the outer surface of the porous sheet to be in a general state of tension and the inner surface of the porous sheet to be in a general state of compression whereby the porous sheet in its unattached areas is forced toward the cold sink.

32. The improved air cooling and water condensate removal structure according to claim 28, wherein the thin porous sheet is a thin perforated sheet having many small perforations with the perforations being so spaced that water which has condensed on the outside surface of the perforated sheet tends to be drawn into the perforations rather than dropping off of the perforated sheet.

33. The improved air cooling and water condensate removal structure according to claim 32, wherein the perforated sheet is mechanically stressed laterally in tension and the outer surface of the perforated sheet is at least slightly convex so that the sheet presses inwardly toward the cold sink.

34. The improved air cooling and water condensate removal structure according to claim 32, wherein the perforated sheet is mechanically stressed laterally in compression and the outer surface of the perforated sheet is concave so that the sheet presses inwardly toward the cold sink.

35. The improved air cooling and water condensate removal structure according to claim 32, wherein the perforated sheet before its mounting onto the main body of the structure having had natural unstrained curvatures which became flattened out upon the mounting of the perforated sheet onto the main body of the structure thereby mechanically stressing the perforated sheet in a manner to cause the outer surface of the perforated sheet to be in a general state of tension and the inner surface of the perforated sheet to be in a general state of compression whereby the perforated sheet in its unattached areas is forced toward the cold sink.

36. The improved air cooling and water condensate removal structure according to claim 32, wherein the perforated sheet is very light and thin and has sufficient flexibility so that the suction within the panel causes the sheet to press inwardly toward the cold sink sufficiently to make reasonably good thermal connections to the cold sink over the broad central cooling area of the perforated sheet.

37. In an air cooling and water condensate removal structure of the type in which the air to be cooled contacts the structure essentially only on its exterior surface without flowing into the structure to any considerable degree so that substantially all of the air remains on the outside of the structure, said structure having:

(1) a heat absorbing cold sink having an outer side facing the air to be cooled, (2) means for cooling the cold sink, (3) a thin broad perforated sheet having many small perforations, the perforated sheet being closely adjacent to and covering the outer side of the cold sink but with a thin broad lateral passageway space provided for on the cold sink side of the perforated sheet, said passageway space communicating with the perforations in the perforated sheet over the broad cooling area of the perforated sheet (4) one or more outlets communicating with the thin passageway space to permit water condensate drawn through the perforated sheet into the thin passageway space from the outside exposed face of the perforated sheet on which moisture from the cooled air has condensed to be drained away, the outlets for draining away the water being separate from the means for cooling the cold sink (5) the perforations in the perforated sheet being so spaced that water which has condensed on the outside surface of the perforated sheet tends to be drawn into the perforations rather than dropping off the perforated sheet, (6) suction pumping means communicating with the passageway space for creating a reduced pressure in the thin passageway space whereby condensate water is readily drawn into this thin passageway space, the improvement residing in the perforated sheet being a compound perforated sheet comprising two perforated sheets coextensive with one another and in close contact with one another and with many of the perforations in the one sheet not coinciding with the perforations in the second sheet so that substantial amounts of the water that is drawn up through the compound sheet must in the water's passage through the compound sheet seep laterally between the two sheets that comprise the compound sheet.

38. In an air cooling and water condensate removal structure of the type in which the air to be cooled contacts the structure essentially only on its exterior surface without flowing into the structure to any considerable degree so that substantially all of the air remains on the outside of the structure, said structure having:

(1) a heat absorbing cold plate, (2) means for cooling the cold plate, (3) a porous sheet closely adjacent to and covering the broad face of the cold plate but with a thin broad lateral passageway space provided for on the cold plate side of the porous sheet said passageway space communicating with the pores in the porous sheet over the broad area of the porous sheet, (4) one or more outlets communicating with the thin passageway space to permit water condensate drawn through the porous sheet into the thin passageway space from the outside exposed face of the porous sheet on which moisture from the cooled air has condensed to be drained away, the outlets for draining away the water being separate from the means for cooling the cold plate, (5) suction pumping means communicating with the passageway space for creating a reduced pressure in the thin passageway space whereby condensate water is readily drawn into this thin passageway space, the improvement residing in a thin undulating flexible sheet situated between the cold plate and the perforated sheet to absorb the expansive forces of freezing water.

39. The improved air cooling and water condensate removal structure according to claim 38, wherein the improvement further resides in the thin undulating flexible sheet having good thermal conductivity and being generally coextensive with the perforated sheet with the aforesaid thin broad lateral passageway space for conducting away water from the perforated sheet being between the undulating sheet and the perforated sheet and with the space between the undulating sheet and the cold plate constituting an air buffer zone, said undulating sheet being free to flex into the air buffer zone when the water in the thin broad lateral passageway space freezes.

40. The improved air cooling and water condensate removal structure according to claim 39, wherein the improvement further resides in the undulating sheet being firmly bonded to both the cold plate and the perforated sheet at numerous points along the undulating sheet, said bonding providing good thermal conduction between the cold plate and the perforated sheet.

41. In an air cooling and water condensate removal structure of the type in which the air to be cooled contacts the structure essentially only on its exterior surface without flowing into the structure to any considerable degree so that substantially all of the air remains on the outside of the structure, said structure having:

(1) a heat absorbing cold plate, (2) means for cooling the cold plate, (3) a porous sheet closely adjacent to and covering the broad face of the cold plate but with a thin broad lateral passageway space provided for on the cold plate side of the porous sheet said passageway space communicating with the pores in the porous sheet over the broad area of the porous sheet, (4) one or more outlets communicating with the thin passageway space to permit water condensate drawn through the porous sheet into the thin passageway space from the outside exposed face of the porous sheet on which moisture from the cooled air has condensed to be drained away, the outlets for draining away the water being separate from the means for cooling the cold plate.

(5) suction pumping means communicating with the passageway space for creating a reduced pressure in the thin passageway space whereby condensate water is readily drawn into this thin passageway space, the improvement wherein the porous sheet is a flexible thermally conductive undulating sheet having crests and troughs.

42. The improved air cooling and water condensate removal structure according to claim 41, wherein the improvement further resides in the tops of many of the crests of the undulating porous sheet being firmly bonded to the cold plate with said bonding areas having a high thermal conductivity and with the space between the troughs of the undulating porous sheet and the cold plate providing the passageway space for the lateral conduction of the water drawn up through the porous sheet, said undulating porous sheet being flexible enough to absorb the expansive forces of the water freezing in the inner passageways.

43. The improved air cooling and water condensate removal structure according to claim 42, wherein many of the neighboring bonded crests are separated by at least one unbonded crest and two troughs, said unbonded crests being free to flex away from the cold plate when pushed by the expansive forces of freezing water thus reducing the mechanical stresses at the bonding areas of the bonded crests.

44. A freezer having a compartment for containing products and for maintaining temperatures in the compartment below the freezing point of water over long time periods, including (1) a cooling panel in the compartment, the panel being of the type having a porous surface exposed to the air to be cooled and having a network of thin drainage channels behind the exposed porous surface for the removal of moisture entering the channels through the pores of the porous surface, (2) means for intermittently cooling the cooling panel to maintain the cooling panel below freezing temperatures, (3) one or more outlets communicating with the thin drainage channels to permit water condensate drawn through the porous surface into the thin drainage channels from the outside exposed face of the porous sheet on which moisture from the cooled air has condensed to be drained away, the outlets for draining away the water being separate from the means for cooling the cooling panel, and (4) means for defrosting the cooling panel after a long freezing period by applying heat for a short period of time to melt the frost accumulated on the porous surface over the long freezing period, the improvement residing in (5) an air circulating fan, (6) a programmed sequencer for controlling the operation of the fan and the defrosting means, said sequencer being programmed to defrost the compartment after long intervals by causing the fan to circulate air relatively rapidly for a prolonged period in which the cooling panel is substantially colder than the non-cooling surfaces in the compartment and causing said prolonged period of air flow by the fan to end relatively shortly before heat is applied to the cooling panel to melt the frost, said sequencer causing said relatively rapid circulation of the air for a prolonged period to occur only after many intermittent coolings of the cooling means to maintain the temperature in the compartment below freezing had occurred, and (7) air flow directing means for causing the fan to blow a substantial quantity of the air within the compartment adjacent to the cooling panel whereby at least a sizeable portion of the frost on the non-cooling surfaces in the compartment is transferred onto the cooling panel.

45. In a freezer compartment for the storage of products at a temperature below the freezing point of water in which some of the interior surfaces of the compartment are cooled by cold producing means having a cold sink directly behind the cooling surfaces and at least some of said cooling surfaces being porous, said freezer compartment being of the type that depends to a large degree for its cooling effect upon thermal convection air currents flowing between the cooling surfaces in the compartment and the stored products, the method for defrosting comprising the steps of (1) intermittently activating the cold producing means in response to a temperature sensor to thereby cool and maintain the compartment below the freezing point of water, (2) after many such intermittent activations of the cold producing means, forceably circulating by mechanical means the air within the compartment for a prolonged period in a manner to cause a substantial portion of the air to flow adjacent to the cooling porous surfaces to thereby transfer at least a sizeable portion of any frost deposits on the non-cooling surfaces, said forced circulation of air being caused to occur at approximately those times that the cooling surfaces are substantially colder than the non-cooling surfaces in the compartment, (3) stopping the forced circulation of air, (4) thereafter defrosting the accumulated frost deposits on the cooling porous surfaces by applying heat to the porous surfaces to melt the accumulated frost on the porous surfaces, (5) at approximately the same time sucking into the porous surfaces the melted frost, (6) terminating the application of heat to the porous surfaces, and (7) then resuming the normal activation of the cold producing means.

46. A method for defrosting a freezer compartment in which products are stored at a temperature below the freezing point of water and in which the compartment is cooled by cold producing means providing cold cooling surfaces in the compartment, said cold producing means removing heat from the cooling surfaces by drawing the heat inwardly into the cooling surfaces and said freezer compartment being of the type that depends to a large degree for its cooling effect upon thermal convection air currents flowing between the cold cooling surfaces in the compartment and the stored products, the method for defrosting comprising the steps of (1) intermittently activating the cold producing means in response to a temperature sensor to maintain the cooling surfaces and the stored products below the freezing point of water, (2) after many such intermittent activations of the cold producing means, forceably circulating the air within the compartment for a prolonged period to cause circulating air to flow adjacent to the cooling surfaces to transfer at least a sizeable portion of any frost deposits on the non-cooling surfaces in the compartment to the cooling surfaces, said forced circulation of air being caused to occur at approximately those times that the cooling surfaces are substantially colder than the non-cooling surfaces in the compartment, (3) stopping the forced circulation of air, (4) thereafter defrosting the accumulated frost deposits on the cooling surfaces by applying heat to the accumulated frost on the cooling surfaces, (5) at approximately the same time collecting the melted frost, (6) terminating the application of heat, and (7) thereafter resuming the normal activation of the cold producing means.

* * * * *